US008220956B2

(12) United States Patent
Lai et al.

(10) Patent No.: US 8,220,956 B2
(45) Date of Patent: Jul. 17, 2012

(54) LED LAMP

(75) Inventors: Chih-Ming Lai, Miao-Li Hsien (TW); Hong-Bin Yang, Miao-Li Hsien (TW); Ming-Young Shiao, Miao-Li Hsien (TW)

(73) Assignee: Foxsemicon Integrated Technology, Inc., Chu-Nan, Miao-Li Hsien (TW)

( * ) Notice: Subject to any disclaimer, the term of this patent is extended or adjusted under 35 U.S.C. 154(b) by 261 days.

(21) Appl. No.: 12/690,251

(22) Filed: Jan. 20, 2010

(65) Prior Publication Data

US 2011/0141723 A1 Jun. 16, 2011

(30) Foreign Application Priority Data

Dec. 15, 2009 (CN) ..... 2009 1 0311453

(51) Int. Cl.
*F21S 4/00* (2006.01)

(52) U.S. Cl. ..... 362/218; 362/217.01; 362/222; 362/249.02; 362/235

(58) Field of Classification Search ..... 362/218, 362/217.01–217.04, 235, 800, 222, 223, 362/646, 227, 249.11, 249.02
See application file for complete search history.

(56) References Cited

U.S. PATENT DOCUMENTS

| | | | | |
|---|---|---|---|---|
| 4,393,323 | A * | 7/1983 | Hubner | 313/110 |
| 6,078,136 | A * | 6/2000 | Sica | 313/493 |
| 6,472,823 | B2 * | 10/2002 | Yen | 315/112 |
| 7,114,830 | B2 * | 10/2006 | Robertson et al. | 362/240 |
| 7,267,461 | B2 * | 9/2007 | Kan et al. | 362/373 |
| 7,611,260 | B1 * | 11/2009 | Lin et al. | 362/224 |
| 7,810,953 | B2 | 10/2010 | Hsu | |
| 7,976,185 | B2 * | 7/2011 | Uang et al. | 362/240 |
| 8,047,674 | B2 * | 11/2011 | Liu | 362/218 |
| 2010/0295468 | A1 * | 11/2010 | Pedersen et al. | 315/294 |

FOREIGN PATENT DOCUMENTS

| | | | |
|---|---|---|---|
| CN | 2736641 | Y | 10/2005 |
| CN | 201184552 | Y | 1/2009 |
| CN | 101487583 | A | 7/2009 |

* cited by examiner

*Primary Examiner* — Anabel Ton
(74) *Attorney, Agent, or Firm* — Altis Law Group, Inc.

(57) ABSTRACT

An LED lamp includes an envelope, two covers, a mounting board and a plurality of LEDs. The covers engages with opposite ends of the envelope. Each of the covers has an electrically conductive part. The mounting board is received in the envelope. Two ends of the mounting board electrically connect with the electrically conductive parts of the two covers, respectively. The LEDs are disposed on the mounting board and received in the envelope.

20 Claims, 11 Drawing Sheets

LED LAMP

BACKGROUND

1. Technical Field

The disclosure relates to LED lamps and, more particularly, to an LED lamp which can be safely and conveniently manipulated during assembly or maintenance.

2. Description of Related Art

Generally, an LED lamp comprises a heat sink, a plurality of LED modules mounted on a first side of the heat sink and a cover covering the LED modules and the first side of the heat sink. A second side of the heat sink is bare; thus, workers may be scalded or scratched by the bare second side of the heat sink in assembly, disassembly or repair of the LED lamp.

What is needed, therefore, is an LED lamp which can overcome the above-described problems.

DETAILED DESCRIPTION

Figure 1:
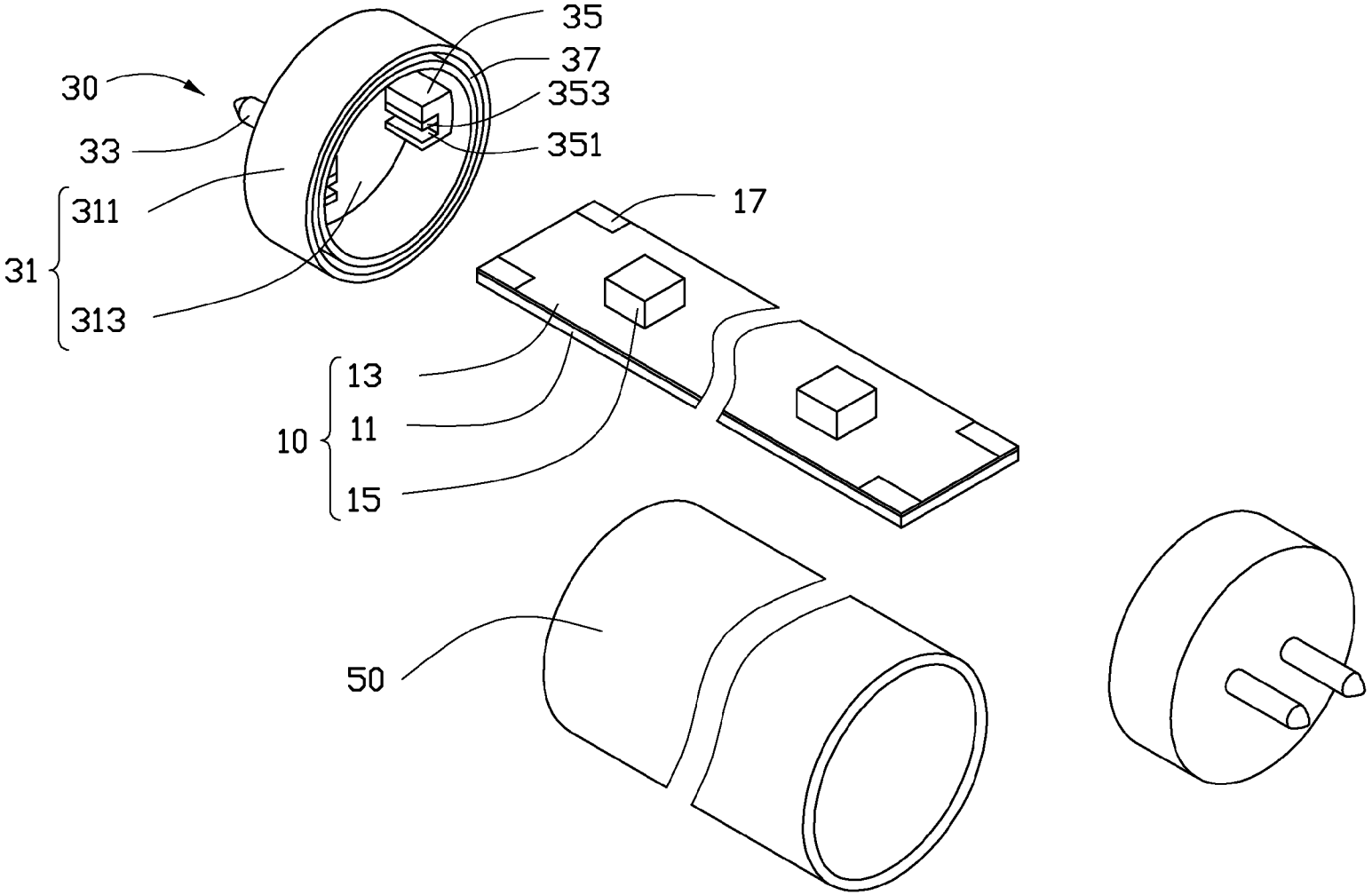
FIG. 1 is an exploded view of an LED lamp in accordance with a first embodiment of the present disclosure.

Referring to FIG. 1, a first embodiment of an LED lamp comprises an LED module 10, two covers 30 mounted on opposite ends of the LED module 10, an envelope 50 sandwiched between the two covers 30 and enclosing the LED module 10 therein.

The LED module 10 comprises a mounting board (not labeled) and a plurality of LEDs 15 mounted on the mounting board. The mounting board comprises an elongated base 11 and an electrically insulating and thermally conductive film 13 formed on a side of the base 11. The LEDs 15 are disposed on the film 13. The base 11 is made of aluminum, copper, tin, gold, tungsten, molybdenum, magnesium, titanium or an alloy thereof. A circuit (not shown) is formed on the film 13. Each end of the base 11 forms two spaced metallic patches 17 electrically connecting the circuit. The LEDs 15 electrically connect to the circuit. The LEDs 15 are arranged in a row along a length direction of the mounting board.

The cover 30 comprises a body 31 and two parallel, spaced metallic pins 33 fixed to the body 31 and extending outwardly from the body 31. The body 31 comprises an annular wall 311 and a circular baffling plate 313 formed on an outer end of the annular wall 311. A central portion of another end of the annular wall 311 defines an annular groove 37 to receive an end of the envelope 50. The pins 33 are mounted on the baffling plate 313 and extend through the baffling plate 313. The pins 33 are provided for electrically connecting a power source (not shown) to drive the LED module 10 to lighten. Two securing members 35 protrude inwardly from an inner surface of the annular wall 311 and face each other. Each of the securing members 35 is a cube and has a groove 351 defined in a top portion thereof, which is remote from the inner surface of the annular wall 311. An electrically conductive part 353 is disposed on an inner surface of the groove 351. The electrically conductive part 353 electrically connects with a corresponding pin 33. The electrically conductive part 353, in the shown embodiment, is a metallic pad. Alternatively, the electrically conductive part 353 can be a metallic film. Opposite sides of an end of the base 11 of the LED module 10 are inserted the grooves 351 of the two securing members 35 of the corresponding cover 30. The patches 17 of the LED module 10 electrically connect with the electrically conductive parts 353 of the two securing members 35 of the cover 30. In another embodiment, the base 11 is made of ceramic, which is electrically insulating and thermally conductive. The mounting board comprises the ceramic base 11 and the circuit is directly formed on the base 11. The film 13 is unnecessary in this embodiment. The base 11 is made of $Si_3N_4$, SiC, $ZrO_2$, $B_4C$, $TiB_2$, $Al_xO_y$, AlN, BeO or Sialon. The patches 17 formed on the base 11 electrically connect with the electrically conductive parts 353 of the securing members 35 of the cover 30, whereby the patches 17 are electrically connected with the pins 33.

The envelope 50 is a cylinder and made of transparent or semi-transparent materials such as resin, epoxy, silicone, polymer and so on. Opposite ends of the envelope 50 are inserted into the grooves 37 of the two covers 30. Thus, the envelope 50 and the covers 30 are assembled together. The LED module 10 is enclosed in the envelope 50. Preferably, an inner surface or an outer surface of the envelope 50 is surface treated so that the light emitted from the LEDs 15 of the LED module 10 can be modulated by the envelope 50 to obtain a desired optical effectiveness, before the light is emitted to an outside of the LED lamp.

Figure 2:
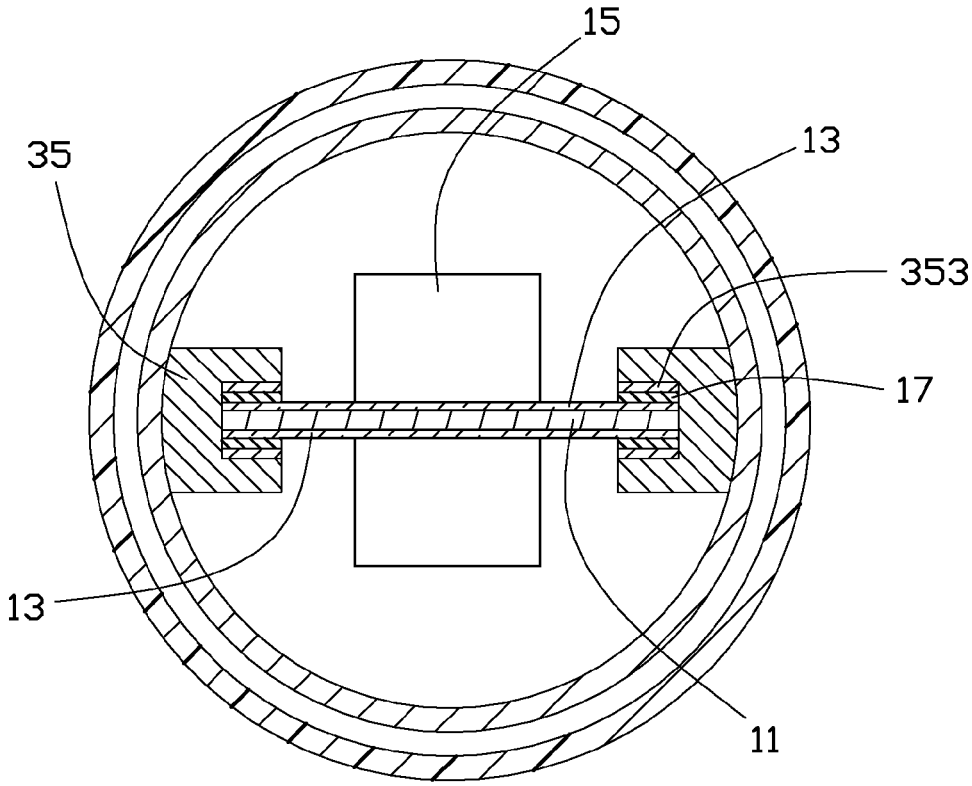
FIG. 2 is a cross sectional view of an LED lamp of a second embodiment of the present disclosure.

Referring to FIG. 2, an LED lamp of a second embodiment is shown. The LED lamp of this embodiment is similar to the LED lamp of the first embodiment except the LED module 10 and the securing member 35. In this embodiment, opposite sides of the base 11 have the films 13 and the patches 17 thereon. The circuits are formed on the films 13. The LEDs 15 are mounted on the films 13 on the opposite sides of the base 11 of the mounting board, respectively. Two electrically conductive parts 353 are formed on two facing inner surfaces of the groove 351. The electrically conductive parts 353 of the securing member 35 electrically connect the patches 17 formed on the films 13 on the opposite sides of the base 11.

Figure 3:
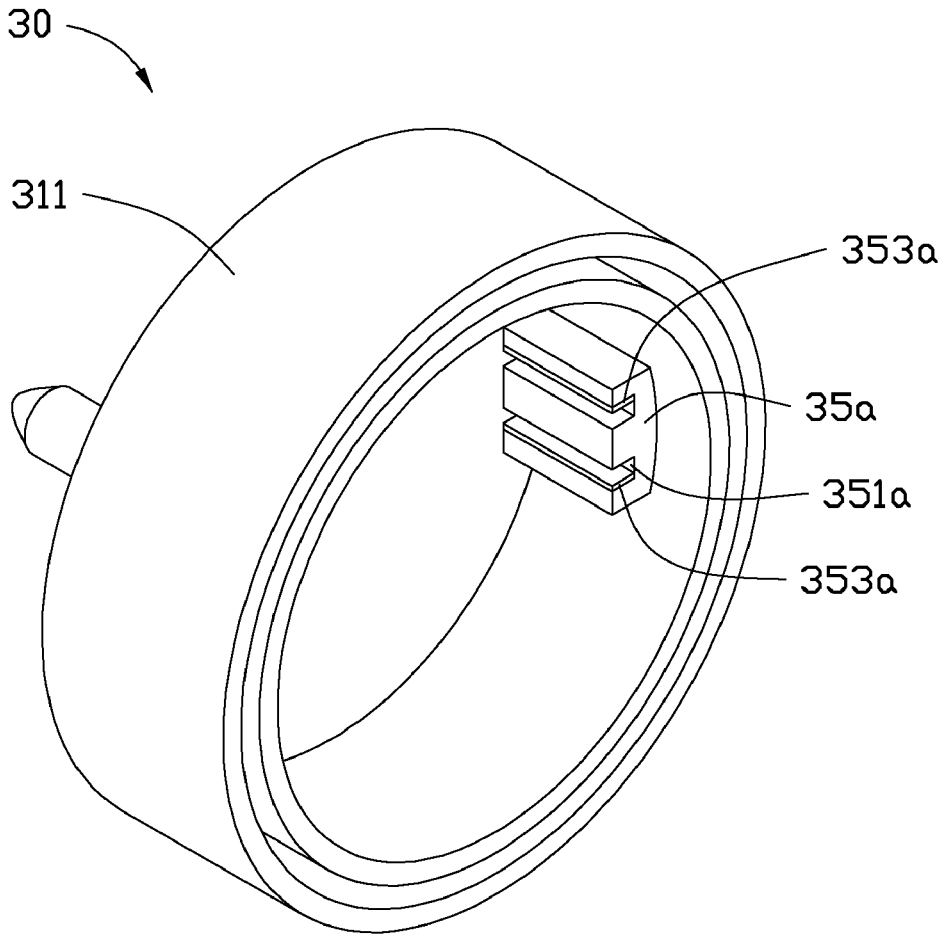
FIG. 3 is an isometric view of a cover of an LED lamp of a third embodiment of the present disclosure.
Figure 4:
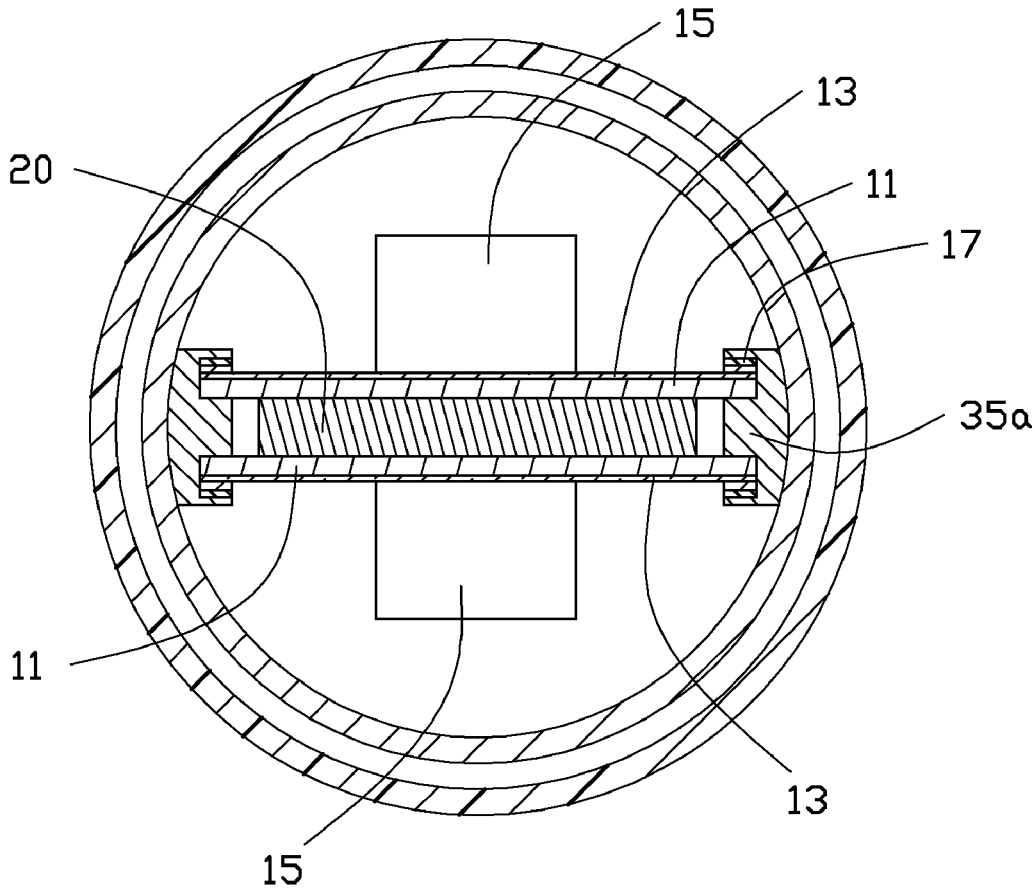
FIG. 4 is a cross sectional view of the LED lamp of the third embodiment of the present disclosure.

Referring to FIGS. 3-4, an LED lamp of a third embodiment is shown. The LED lamp comprises securing members **35*a* different from the securing members 35 of the first embodiment. The securing members 35*a* defines two spaced, parallel grooves 351*a* therein. An electrically conductive part 353*a* is formed on an inner surface of each of the grooves 351*a*. An end of the base 11 of a first LED module 10 is inserted into an upper groove 351*a*, while an end of the base 11 of a second LED module 10 is inserted into a lower groove 351*a*. The patches 17 on the bases 11 of the mounting boards electrically connect the electrically conductive parts 353*a* of the securing members 35*a***.

When the two LED modules 10 and the covers 30 are assembled together, the LEDs 15 of the two LED modules 10 are oriented toward opposite directions and the bases 11 are parallel to and spaced from each other. A heat absorbing plate 20 is sandwiched between and thermally contacts the two bases 11. The heat absorbing plate 20 is a heat pipe, a vapor chamber, a ceramic plate, or a metallic plate.

Figure 5:
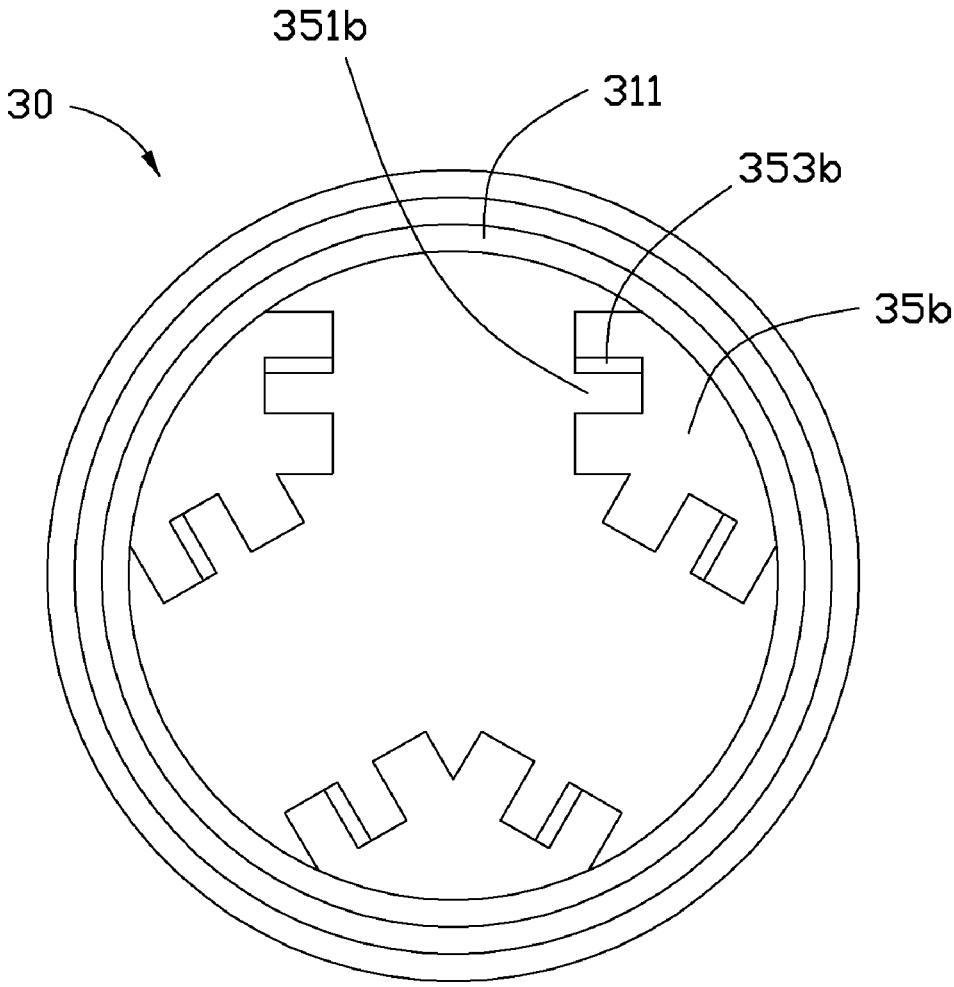
FIG. 5 is a side view of a cover of an LED lamp of a fourth embodiment of the present disclosure.
Figure 6:
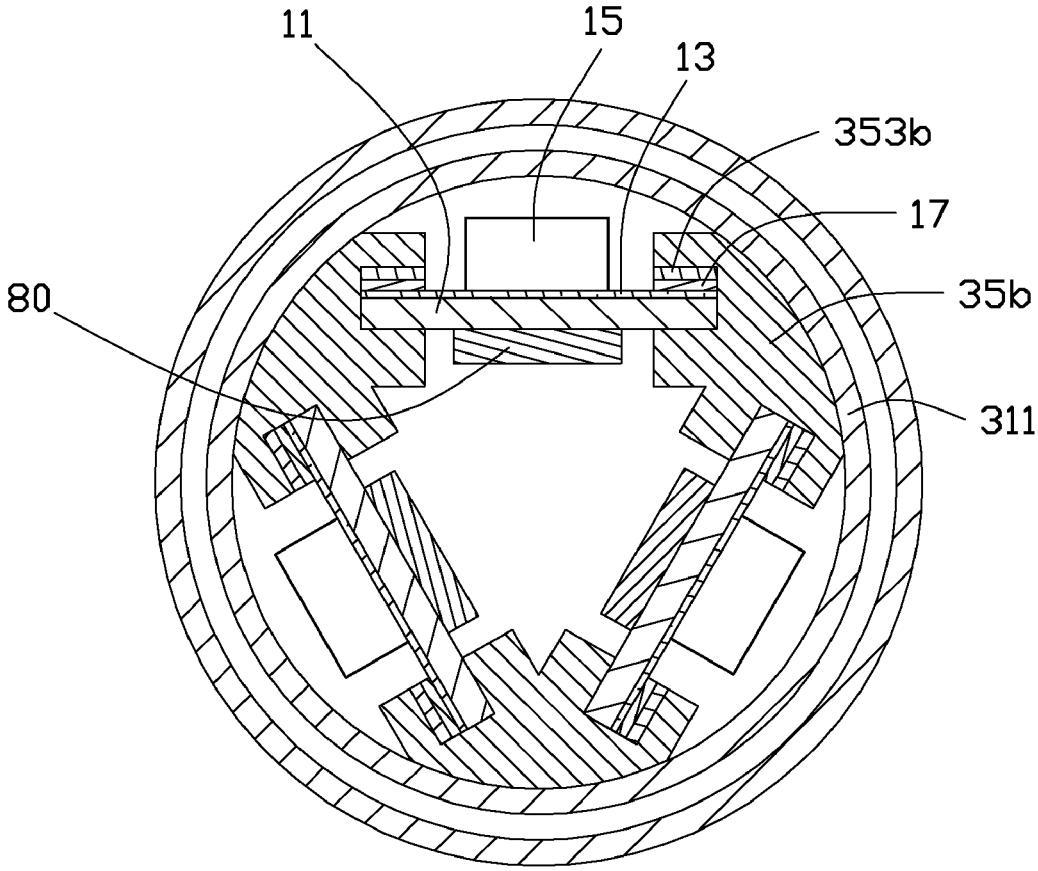
FIG. 6 is a cross sectional view of the LED lamp of the fourth embodiment of the present disclosure.

Referring to FIGS. 5-6, an LED lamp of a fourth embodiment is shown. The cover 30 of the LED lamp comprises three securing members 35*b* different from the securing members 35 of the first embodiment. The three securing members 35*b* are spaced from each other and evenly protrude from the inner surface of the annular wall 311 of the body 31 of the cover 30. Each of the securing members 35*b* has a substantially sector-shaped configuration. An end of the securing member 35*b* spaced from the inner surface of the annular wall 311 defines two spaced grooves 351*b* oriented toward different directions. Three pairs of confronting grooves 351*b* are accordingly defined by the three securing members 35*b*, which are used to mount the three LED modules 10 in the LED lamp. Two confronting grooves 351*b* of two adjacent securing members 35*b* engagingly receive the opposite sides of the end of the base 11 of the LED module 10. An electrically conductive part 353*b* is formed on an inner surface of the groove 351*b* to electrically connect with the patch 17 of the LED module 10.

When the LED lamp is assembled, three LED modules 10 engage with the two covers 30. In this state, the opposite sides of one end of the base 11 of the LED module 10 are inserted into the two grooves 351*b* facing each other. The patches 17 of the base 11 electrically connect the electrically conductive parts 353*b* of the securing members 35*b*. The three bases 11 of the three LED modules 10 form a triangular configuration. The LEDs 15 of the LED modules 10 are mounted on outer surfaces of the triangular configuration and are oriented toward the envelope 50. Three heat absorbing plates 80 are located at inner surfaces of the triangular configuration and directly contact the bases 11, respectively. The heat absorbing plates 80 each are a heat pipe, a vapor chamber, a ceramic plate, or a metallic plate.

Figure 7:
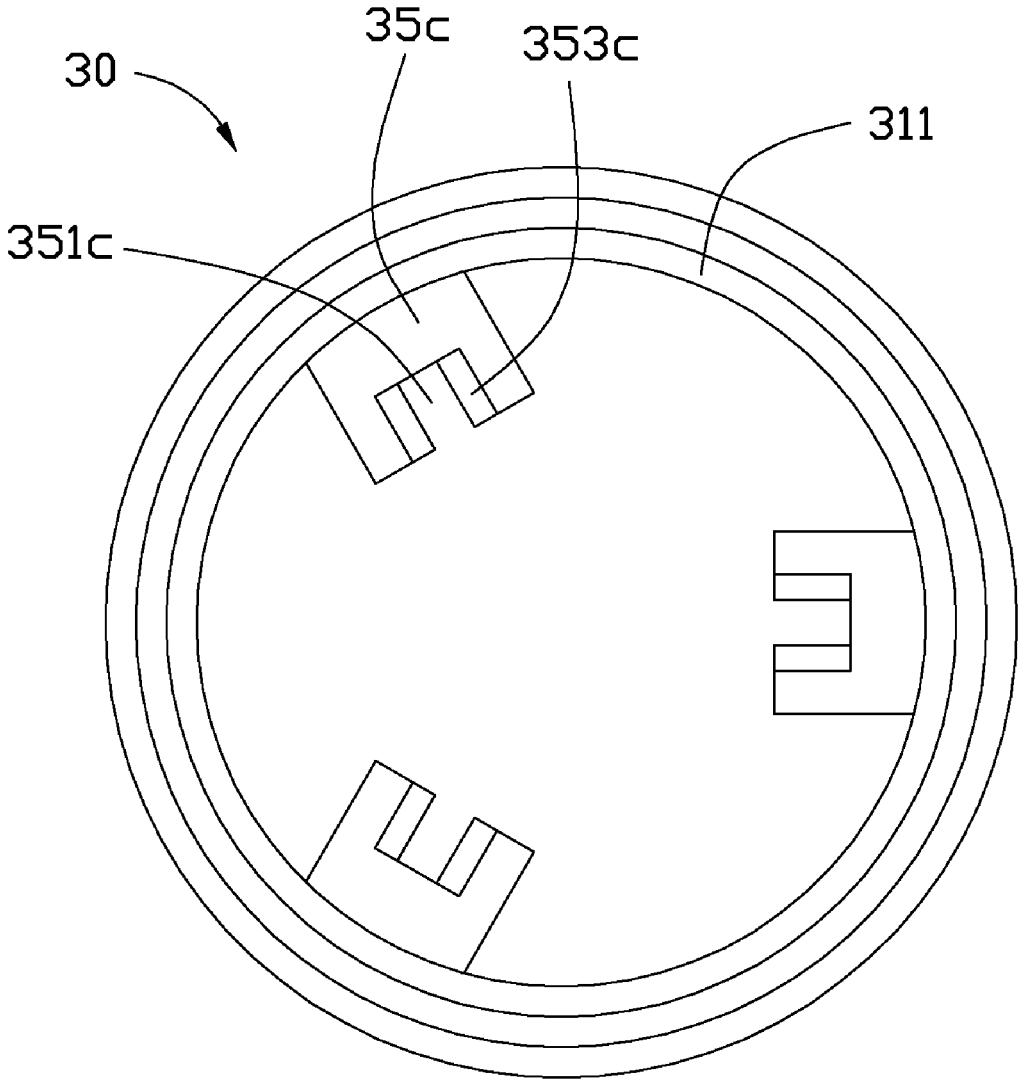
FIG. 7 is a side view of a cover of an LED lamp of a fifth embodiment of the present disclosure.
Figure 8:
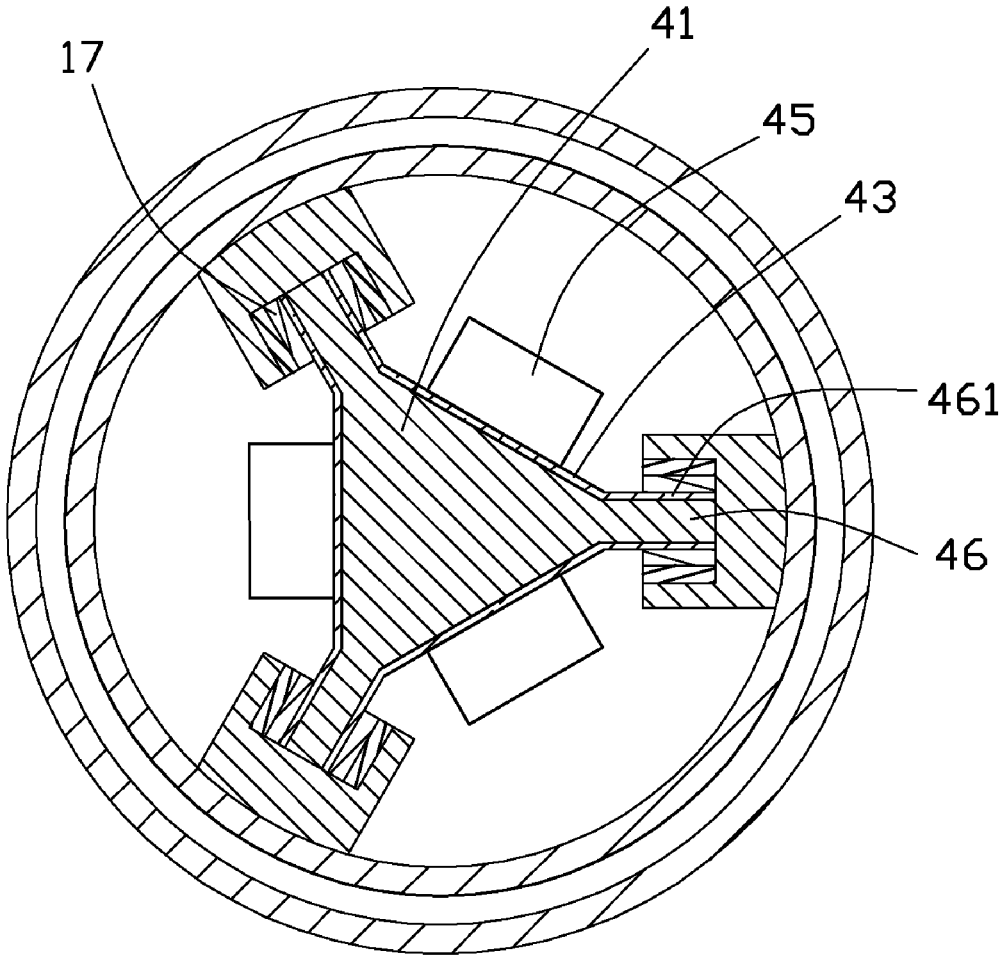
FIG. 8 is a cross sectional view of the LED lamp of the fifth embodiment of the present disclosure.
Figure 9:
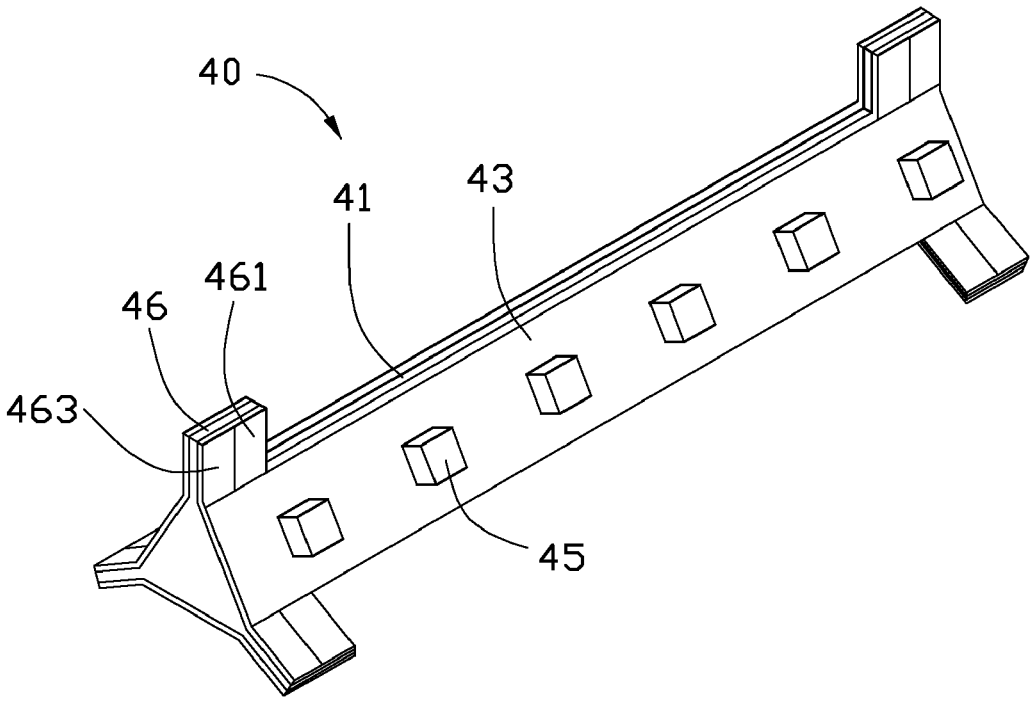
FIG. 9 is an isometric view of an LED module of the LED lamp of the fifth embodiment of the present disclosure.

Referring to FIGS. 7-9, an LED lamp of a fifth embodiment is shown. The cover 30 of the LED lamp comprises three securing members 35*c* different from the securing members 35*b* of the fourth embodiment. Each of the securing members 35*c* is a cube and defines a groove 351*c* in a top thereof, which is distant from the inner surface of the annular wall 311. Two electrically conductive parts 353*c* are formed on opposite inner surfaces of the groove 351*c*. The electrically conductive parts 353*c* of the cover 30 form an anode and a cathode electrically connect with the pins 33, respectively.

The LED lamp comprises an LED module 40 different from the LED module 10. The LED module 40 comprises a heat absorbing portion 41. The heat absorbing portion 41 is a solid, metallic triangular prism, a heat pipe or a vapor chamber. Each outer surface of the heat absorbing portion 41 has an electrically insulating and thermally conductive film 43 coated thereon. A circuit (not shown) is formed on the film 43. A number of LEDs 45 are mounted on each of the outside surfaces of the heat absorbing portion 41 and electrically connect with the circuit. Each end of the heat absorbing portion 41 has three elongated ridges 46. The ridges 46 of a corresponding end of the heat absorbing portion 41 extend outwardly from three apexes of the heat absorbing portion 41. The ridge 46 is shorter than the heat absorbing portion 41. The film 43 has an extended portion 461 covering an outer surface of the ridge 46. The circuit (not shown) extends to the extended portion 461 of the film 43 on the ridge 46. A metallic patch 463 is formed on the outer surface of the ridge 46 and electrically connects with the circuit. When the LED lamp is assembled, the ridges 46 are inserted into the grooves 351*c* and the patches 463 on the ridges 46 electrically connect with the electrically conductive parts 353*c*. In another embodiment, the heat absorbing portion 41 and the ridges 46 are made of ceramic, which is electrically insulating and thermally conductive. The insulating film 43 is unnecessary in this embodiment. The heat absorbing portion 41 and the ridges 46 are made of $Si_3N_4$, SiC, $ZrO_2$, $B_4C$, $TiB_2$, $Al_xO_y$, AlN, BeO, or Sialon.

Figure 10:
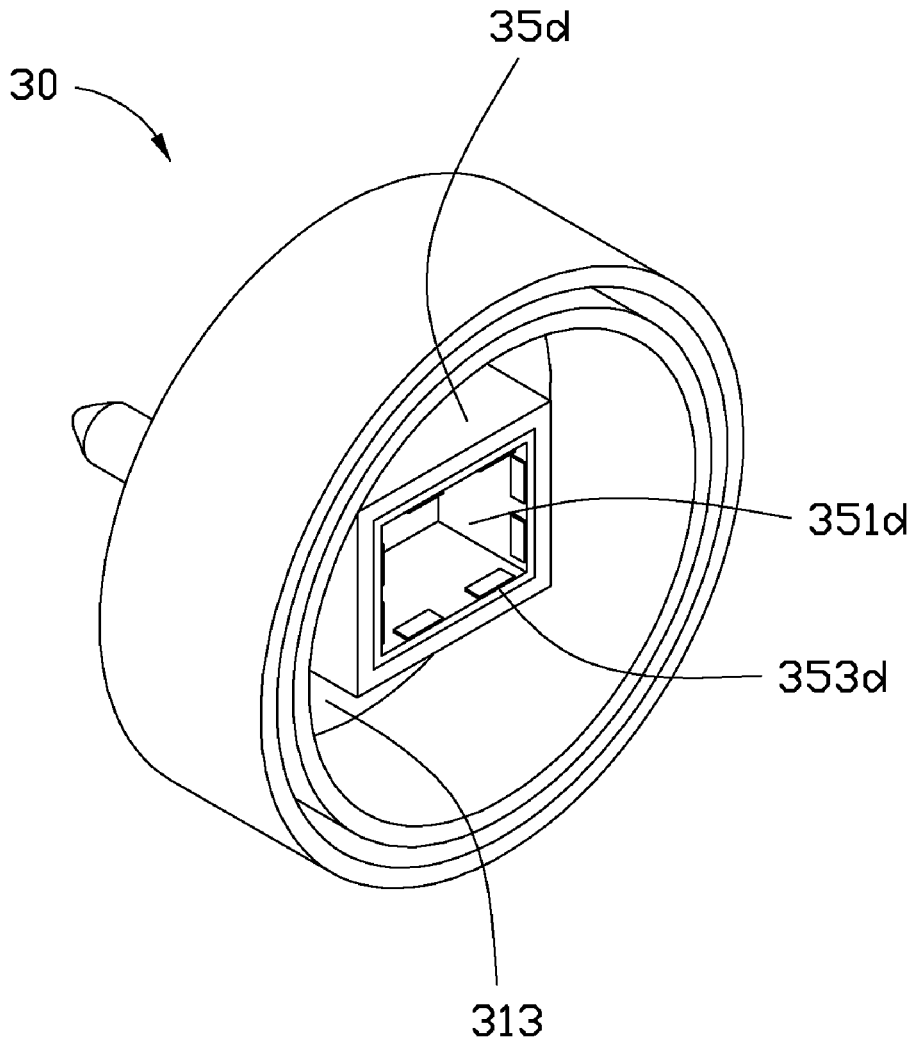
FIG. 10 is an isometric view of a cover of an LED lamp of a sixth embodiment of the present disclosure.
Figure 11:
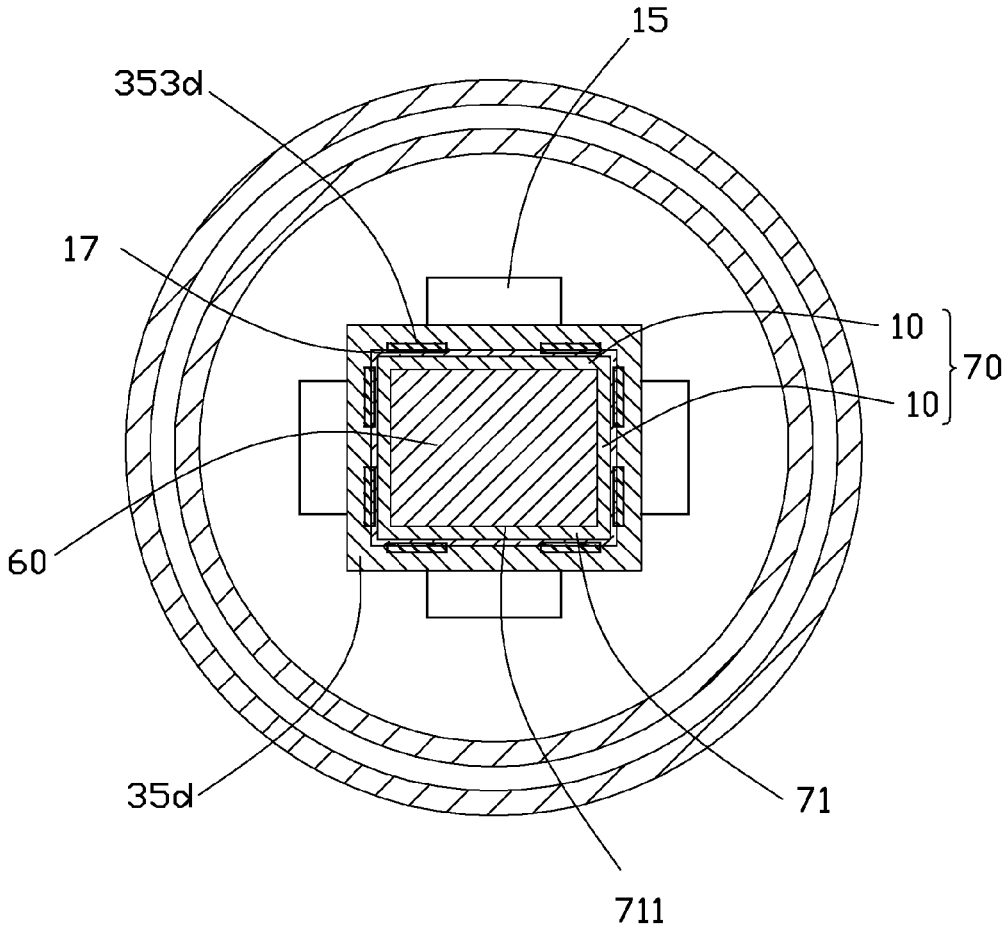
FIG. 11 is a cross sectional view of the LED lamp of the sixth embodiment of the present disclosure.

Referring to FIGS. 10-11, an LED lamp of a sixth embodiment is shown. The LED lamp comprises an LED module 70 different from the LED module 10 of the first embodiment. The LED module 70 is cube and formed by four LED modules 10. The bases 11 of the four LED modules 10 interconnect each other to form a rectangular base 71. A central portion of the base 71 is a hollow to define a chamber 711. A rectangular heat absorbing portion 60 is fittingly received in the chamber 711. The heat absorbing portion 60 thermally contacts with the base 71. The LEDs 15 are located at outer surfaces of the base 71. The heat absorbing portion 60 is a heat pipe, a vapor chamber, a ceramic plate, or a metallic plate.

The cover 30 of the LED lamp of this embodiment comprises a securing member 35*d* different from the securing member 35 of the first embodiment. The securing member 35*d* extends inwardly from a central portion of the baffling plate 313 of the cover 30. The securing member 35*d* is a hollow cube and has a chamber 351*d* defined at a central portion thereof. A number of electrically conductive pads 353*d* are formed on each inner surface of the chamber 351*d* to electrically connect with the patches 17.

When the LED lamp is assembled, an end of the LED module 70 is inserted into the chamber 351*d* of the cover 30 and the pads 353*d* of the securing member 35*d* electrically connect with the patches 17.

It is to be understood, however, that even though numerous characteristics and advantages of the disclosure have been set forth in the foregoing description, together with details of the structure and function of the disclosure, the disclosure is illustrative only, and changes may be made in detail, especially in matters of shape, size, and arrangement of parts within the principles of the disclosure to the full extent indicated by the broad general meaning of the terms in which the appended claims are expressed.

What is claimed is:

1. An LED (light emitting diode) lamp comprising:

an envelope;

two covers engaging with opposite ends of the envelope, each of the covers having an electrically conductive part; and a mounting board received in the envelope and, two ends of the mounting board electrically connecting with the electrically conductive parts of the two covers, respectively;

a plurality of LEDs disposed on the mounting board and received in the envelope;

wherein each cover has a securing member, the electrically conductive part is a metallic film or a metallic pad formed on the securing member to electrically connect the mounting board; and wherein the securing member defines a groove therein, and the electrically conductive part is formed on an inner surface of the securing member defining the groove, one of the two ends of the mounting board is received in the groove of the securing member and electrically connects with the electrically conductive part.

2. The LED lamp as claimed in claim 1, wherein the mounting board comprises a base, a circuit formed on a side of the base, and metallic patches formed on two ends of the side of the base and electrically connecting the circuit, the LEDs electronically connect the circuit, the patches electronically connect the electrically conductive parts of the covers.

3. The LED lamp as claimed in claim 2, wherein each of the covers has two spaced securing members, opposite sides of one of the two ends of the base of the mounting board are inserted into the two grooves of the two securing members of the cover, and the patches of the mounting board electrically connect with the electrically conductive parts of the securing members.

4. The LED lamp as claimed in claim 3, wherein another opposite side of the base has circuit, patches and LEDs formed thereon, another inner surface of each of the grooves forms another electrically conductive part electrically connecting with the patches formed on the another opposite side of the base.

5. The LED lamp as claimed in claim 3 further comprising another mounting board having LEDs thereon, wherein the securing member has another groove with an electrically conductive part formed on an inner surface thereof, a side of one of two ends of the base of the another mounting board is inserted into the another groove, and a patch of the another mounting board electronically connects with the electrically conductive part of the another groove.

6. The LED lamp as claimed in claim 5, wherein the two mounting boards are so positioned that one is located above the other and the LEDs disposed on the two mounting boards are oriented toward opposite directions.

7. The LED lamp as claimed in claim 6, wherein a heat absorbing plate is sandwiched between the two mounting boards and thermally contact with the two mounting boards.

8. The LED lamp as claimed in claim 2, wherein each of the covers has three spaced securing members, each of the securing members defies two spaced grooves, three mounting boards engage with the three securing members, the opposite sides of one of the two ends of the base of the corresponding mounting board is inserted into two facing grooves of two adjacent securing members, and the patches of the corresponding mounting board electrically connect with the electrically conductive parts of the two adjacent securing members.

9. The LED lamp as claimed in claim 8, wherein the three mounting boards form a triangular configuration and the LEDs are mounted on outer surfaces of the triangular configuration.

10. The LED lamp as claimed in claim 9, wherein three heat absorbing plates are located at inner surfaces of the triangular configuration and thermally contact with the mounting boards.

11. The LED lamp as claimed in claim 2, wherein the base is a polyhedron and outer surfaces of the base are oriented toward different directions, the LEDs are mounted on the outer surfaces of the base.

12. The LED lamp as claimed in claim 11, wherein each end of the base has a plurality of ridges extending outwardly therefrom, the patches are formed on the ridges, a plurality of securing members are formed on the cover, the ridges are received in the grooves of the securing members of the cover, the patches electrically connect with the electrically conductive parts of the securing members of the cover.

13. The LED lamp as claimed in claim 12, wherein the base is a triangular prism, three the ridges extend outwardly from three apexes of one of the two ends of the base, three securing members are formed on the cover and engage with the ridges.

14. The LED lamp as claimed in claim 11, wherein the base is cuboid and opposite ends thereof are inserted in the grooves of the two covers.

15. The LED lamp as claimed in claim 14, wherein a heat absorbing portion is received in a central portion of the base and thermally contacts with the base.

16. The LED lamp as claimed in claim 1, wherein the envelope is a cylinder and an inner surface or an outer surface thereof is surface treated to modulate light generated by the LEDs.

17. The LED lamp as claimed in claim 16, wherein each cover defines a groove to receive an end of the envelope.

18. The LED lamp as claimed in claim 1, wherein two metallic pins are mounted on the cover and electrically connect with the electrically conductive parts.

19. The LED lamp as claimed in claim 2, wherein the base is metallic and an electrically insulating and thermally conductive film is formed on the base and the circuit is formed on the film.

20. The LED lamp as claimed in claim 2, wherein the base is made of ceramic.

* * * * *